US007633029B2

(12) United States Patent
Komori et al.

(10) Patent No.: US 7,633,029 B2
(45) Date of Patent: Dec. 15, 2009

(54) SAFETY SWITCH

(75) Inventors: Etsurou Komori, Osaka (JP); Takao Fukui, Osaka (JP); Norifumi Obata, Osaka (JP); Takeo Yasui, Osaka (JP)

(73) Assignee: IDEC Corporation, Osaka (JP)

( * ) Notice: Subject to any disclaimer, the term of this patent is extended or adjusted under 35 U.S.C. 154(b) by 141 days.

(21) Appl. No.: 11/886,169

(22) PCT Filed: Mar. 3, 2006

(86) PCT No.: PCT/JP2006/304076

§ 371 (c)(1),
(2), (4) Date: Sep. 10, 2007

(87) PCT Pub. No.: WO2006/095645

PCT Pub. Date: Sep. 14, 2006

(65) Prior Publication Data

US 2008/0121499 A1 May 29, 2008

(30) Foreign Application Priority Data

Mar. 8, 2005 (JP) ..... 2005-063333

(51) Int. Cl.
*H01H 9/20* (2006.01)

(52) U.S. Cl. ..... 200/334; 200/43.04

(58) Field of Classification Search ..... 200/43.01, 200/43.04, 43.09, 17 R, 200, 334, 61.62
See application file for complete search history.

(56) References Cited

U.S. PATENT DOCUMENTS 5,420,385 A * 5/1995 Cooper ..... 200/43.07
5,622,253 A * 4/1997 Wecke et al. ..... 200/43.07
5,703,339 A * 12/1997 Rapp et al. ..... 200/17 R
5,777,284 A 7/1998 Mohtasham
5,821,484 A * 10/1998 Schulze et al. ..... 200/17 R (Continued)

FOREIGN PATENT DOCUMENTS

| | | |
|---|---|---|
| JP | 62-40522 | 10/1987 |
| JP | 3-50733 | 5/1991 |
| JP | 7-254332 | 10/1995 |
| JP | 9-507333 | 7/1997 |
| JP | 9-245584 | 9/1997 |

(Continued)

OTHER PUBLICATIONS

U.S. Appl. No. 11/919,375, Komori et al., filed Oct. 25, 2007.

*Primary Examiner*—Michael A Friedhofer
*Assistant Examiner*—Lisa N Klaus
(74) *Attorney, Agent, or Firm*—Jordan and Hamburg LLP

(57) ABSTRACT

A safety switch capable of detecting withdrawal of an actuator from a switch main unit in a sure and reliable manner even when the safely switch, including a lock mechanism, is in a locked condition and an attempt is made to forcibly withdraw the actuator from the switch main unit. Even when a drive cam becomes capable of rotation since not less than one of a notch cut-out section and a lock member is broken by forcibly extracting an actuator with rotation of the drive cam locked, a cam curve section of the drive cam and an operating rod are in a normal condition and free of breakage. Accordingly, if the drive cam rotates in a counter-clockwise direction, normally-closed contacts of a contact section adopt an open condition normally, and even in situations where the actuator is withdrawn from the switch main unit with a force equal to or greater than the fracture strength of the safety switch, withdrawal of the actuator from the switch main unit can be detected in a sure and reliable manner.

7 Claims, 6 Drawing Sheets

U.S. PATENT DOCUMENTS

| | | | | |
|---|---|---|---|---|
| 5,959,270 | A * | 9/1999 | Wecke et al. | 200/43.07 |
| 6,194,674 | B1 * | 2/2001 | Fukui | 200/43.04 |
| 6,307,167 | B1 * | 10/2001 | Kajio et al. | 200/43.11 |
| 6,310,305 | B1 * | 10/2001 | Kamino et al. | 200/43.11 |
| 6,627,827 | B2 | 9/2003 | Low et al. | |
| 6,720,508 | B2 * | 4/2004 | Moriyama et al. | 200/200 |
| 7,071,436 | B2 * | 7/2006 | Coates | 200/341 |
| 7,138,589 | B2 * | 11/2006 | Tanaka et al. | 200/43.04 |
| 7,339,125 | B2 * | 3/2008 | Day | 200/43.04 |
| 7,345,252 | B2 * | 3/2008 | Takenaka et al. | 200/334 |
| 7,429,708 | B1 * | 9/2008 | Poyner et al. | 200/43.04 |
| 7,504,597 | B2 * | 3/2009 | Shimazu et al. | 200/43.04 |
| 2003/0005732 | A1 | 1/2003 | Moriyama et al. | |
| 2009/0065340 | A1 | 3/2009 | Komori et al. | |

FOREIGN PATENT DOCUMENTS

| | | |
|---|---|---|
| JP | 10-334772 | 12/1998 |
| JP | 2000-207979 | 7/2000 |
| JP | 2002-140962 | 5/2002 |
| JP | 2002-367470 | 12/2002 |
| JP | 2003-45294 | 2/2003 |
| JP | 2003-331696 | 11/2003 |
| JP | 2005-38664 | 2/2005 |

* cited by examiner

SAFETY SWITCH

BACKGROUND OF THE INVENTION

The present invention relates to a safety switch mounted on a peripheral wall surface of a protective door of, for example, industrial machinery etc., and stopping a supply of power to the industrial machinery etc. when the protective door is opened.

Conventionally, the protective door etc. of industrial machinery has been provided with a safety switch preventing the machinery from being driven in situations where the protective door is not fully closed in order to avert accidents wherein a worker is injured as a result of entrapment in the machinery. As an example of this type of safety switch, the safety switch disclosed in Patent Document 1 is provided with a lock mechanism that mechanically locks an operating key after the operating key has been inserted into the safety switch, thus preventing extraction of the operating key.

A safety switch provided with this lock mechanism is electrically connected to industrial machinery such as a robot and includes a switch main unit (key switch) and an actuator (key); furthermore, the switch main unit is fixed to a peripheral wall surface of a protective door and the actuator is fixed to the protective door. A fixing position of the actuator at that time is set opposing a key insertion opening of the switch main unit and enabling entry into a head case at a top-left portion of the switch main unit when the protective door is in a closed condition.

Then, as a result of entry of the actuator, a contact disposed below the head case of the switch main unit switches to a closed condition and power is supplied to electrical machinery, allowing the machinery to be driven. Meanwhile, when the actuator withdraws as a result of opening of the protective door and is extracted from the head case, the integrated contact switches to an open condition, and the supply of power to the machinery is cutoff.

It should be noted that the head case is provided with a cam unit (drive cam) engaged with the actuator and rotating pursuant to entry and withdrawal of the actuator, and a follower disposed below the cam unit and moving vertically along an outer surface of the cam (cam curve section) as the cam unit rotates. Also, a working member and an operating member coupled to the follower and moving vertically and a contact opening and closing in a coupled manner with the operating member are provided inside the switch main unit disposed below the head case. Furthermore, the follower, the working member, and the operating member are urged upwards by a spring disposed in the vicinity of the operating member; the follower maintains sliding contact with the outer surface of the cam unit; the follower, the working member, and the operating member move vertically integrally pursuant to the rotation of the cam unit; and the contacts are switched between the open and closed conditions thereof in a coupled manner with this vertical motion.

In addition, this safety switch is also provided with a lock mechanism including a lock component (lock member), moving horizontally, an L-shaped lock lever, and a plunger. The lock lever is axially supported at a central portion thereof so as to be capable of freely rotating; a left end and a right end of the lock lever are connected so as to be capable of freely rotating to a right end portion of the lock component and a lower end side of the plunger, respectively; and a motion of the plunger is transferred to the lock component via the rotation of the lock lever. Furthermore, the lock component is urged leftward by a spring. Accordingly, pursuant to rotation of the cam unit in a clockwise direction, the follower slides from a large diameter portion of the outer surface of the cam unit to a small diameter portion thereof, the operating member moves upward as a result of the urging of the spring, and in addition, the lock component moves leftward. Consequently, the lock component moves underneath the operating member, blocking downward motion thereof; the cam unit becomes engaged by the follower; the cam unit is held in a locked condition, prevented from rotating; and extraction of the actuator is blocked.

Furthermore, a magnetic solenoid for driving the plunger of the lock mechanism is disposed at an upper-right portion inside the switch main unit, and the plunger is moved up and down as a result of energizing of the magnetic solenoid being started and stopped, respectively, by external control. Then, the magnetic solenoid is non-energized with the cam unit in the locked condition, and if the condition of the magnetic solenoid is changed from non-energized to energized, the plunger moves upward as a result of the magnetic attraction force thereof, the lock lever rotates in a counter-clockwise direction as a result of the upward motion of the plunger, the lock member moves rightward as a result thereof, allowing the operating member to move down and the cam unit to rotate in a counter-clockwise direction. Consequently, the cam unit is released from the locked condition to an unlocked condition and the actuator can be extracted.

Patent Document 1: JP H9-245584A ([0035] to [0044], FIG. 1)

SUMMARY OF THE INVENTION

It should be noted that, in the conventional safety switch as explained above, there is a danger that the following problem can occur when a force in the direction of extraction and exceeding the fracture strength of the cam curve section (cam outer surface) of the drive cam is forcibly applied to the actuator while the drive cam (cam unit) is in the locked condition and the actuator, blocked from being extracted, has not been released from the locked condition normally through energization of the magnetic solenoid. That is to say, when an attempt is made to forcibly withdraw and extract the actuator, a force urges the drive cam engaged with the actuator to rotate. As the magnetic solenoid is not energized, however, the lock mechanism remains in the locked condition, and the follower (operating rod) remains engaged with the small diameter portion of the cam curve section of the drive cam. Consequently, if the actuator extraction force is large and exceeds the fracture strength of the cam curve section, the cam curve section breaks, enabling rotation of the drive cam, and the drive cam rotates pursuant to extraction of the actuator.

Although the cam curve section of the drive cam has broken, however, the lock mechanism remains in the locked condition and the follower (operating member) remains in the upper position, and despite the fact that the actuator is being extracted, the contact of the switch main unit continues to output an electrical signal indicating that the actuator is in the entry condition.

In recognition of the above-explained problem, it is an object of the present invention to provide a safety switch that can detect withdrawal of the actuator from the switch main unit in a sure and reliable manner even when the safety switch, including a lock mechanism, is in a locked condition and the actuator is forcibly withdrawn from the switch main unit thereof.

As a means of resolving the above-explained problems, the safety switch according to the present invention having an actuator provided so as to be capable of freely entering into and withdrawing from an operation section of a switch main unit, and detecting entry and withdrawal of the actuator when a contact of a contact section perform opening and closing as a result of a reciprocating motion of an operating rod provided in a switch section in accordance with entry and withdrawal of the actuator, includes a drive cam that is provided so as to be capable of freely rotating in the operation section and a lock mechanism that is provided in a lock mechanism section of the switch main unit and locks a rotation of the drive cam; in which the drive cam having an engagement section, a notch cut-out section, and a cam curve section each formed on an outer peripheral surface of the drive cam, the engagement section engaging with a portion of the actuator pursuant to pushing in of the actuator, is rotated in one direction along with entry of the actuator into the operation section while retaining the engagement condition; and is rotated in another direction along withdrawal of the actuator from the operation section pursuant to extraction of the actuator until the portion of the actuator comes free of the engagement condition with the engagement section; and thus the operating rod moves in a reciprocating fashion as a result of the operating rod making sliding contact with the cam curve section due to rotation of the drive cam in both directions; and the lock mechanism comprises a lock member and a drive section that moves the lock member, the lock member being provided so as to be capable of freely moving between a lock position and an unlock position in a direction substantially perpendicular to a rotating shaft of the drive cam, engaging with the notch cut-out section to lock a rotation of the drive cam as a result of motion to the lock position when the actuator is in an entry condition, and being released from engagement with the notch cut-out section as a result of motion to the unlock position. (Claim 1)

In an invention of such a configuration, a portion of the actuator engages with the engagement section pursuant to the actuator pushing into and entering the operation section of the switch main unit, and the drive cam is rotated in one direction by the actuator while retaining this engagement condition. As a result of the cam curve section of the drive cam and the operating rod sliding in a condition of mutual contact pursuant to this rotation of the drive cam, the operating rod moves, and pursuant to this motion of the operating rod, the contacts of the contact section perform opening and closing. Also, as a result of the drive section of the lock mechanism moving the lock member to the lock position, the lock member and the notch cut-out section of the drive cam engage, and the rotation of the drive cam is locked. As a result, withdrawal of the actuator engaged with the drive cam is prevented and the actuator cannot be extracted from the operation section.

In this way, in a situation wherein an attempt is made to forcibly withdraw and extract the actuator from the operation section with the rotation of the drive cam in the locked condition, since a portion of the actuator is engaged with the engagement section of the drive cam, a forcible rotation force is applied to the drive cam. However, as the lock member remains engaged with the notch cut-out section of the drive cam, not less than one of the notch cut-out section and the lock member may be broken when the force extracting the actuator is large. As a result, the drive cam becomes capable of rotating and rotates in another direction pursuant to extraction and withdrawal of the actuator from the operation section, and a portion of the actuator comes free of the engagement condition with the engagement section. At this time, as the cam curve section of the drive cam and the operating rod are in a normal condition and free of breakage, pursuant to the rotation of the drive cam in the other direction, the cam curve section and the operating rod make sliding contact while the operating rod moves. Also, as the contacts of the contact section perform opening and closing normally pursuant to the motion of the operating rod, it is possible, for example, to detect the extraction (withdrawal) of the actuator based on this opening and closing of contacts. Accordingly, even in situations where the actuator is withdrawn from the switch main unit with a force equal to or greater than the fracture strength of the safety switch, withdrawal of the actuator from the switch main unit can be detected in a sure and reliable manner.

Furthermore, a configuration can also be such that a tip section of the lock member engages with the notch cut-out section, and a fracture strength of the tip section is set lower than a fracture strength of the notch cut-out section of the drive cam. (Claim 2) Furthermore, it is desirable that the lock member include a base and a tip section connected to the base, and that a deficiency section is formed in order to reduce a fracture strength at a boundary portion between the tip section and the base; in addition, it is desirable that the lock member include a base and a tip section connected to the base, and that the tip section is bonded to the base.

As a result of such a configuration, as the fracture strength of the tip section of the lock member is set lower than the fracture strength of the notch cut-out section of the drive cam, the tip section of the lock member is more liable to break than the notch cut-out section of the drive cam. For this reason, when the actuator has entered the safety switch and, in a condition wherein the lock member has engaged with the notch cut-out section and the drive cam has been locked, the actuator is forcibly withdrawn from the switch main unit, even though the extraction force at this time is concentrated in the portion of engagement of the lock member, engaged with the drive cam, and the notch cut-out section, the tip section of the lock member of lower fracture strength breaks before the notch cut-out section of the drive cam and the drive cam becomes capable of rotation. In this way, when the actuator is forcibly extracted from the switch main unit, only the tip section of the lock member breaks and the other portions of the safety switch retain a normal condition. Accordingly, replacement of the broken lock member alone makes it possible for the safety switch to again be used in a normal condition, and therefore, a cost reduction can be realized.

Furthermore, the contact section can be connected electrically within the switch main unit to an end portion of an external connection cable, and can be configured as an item detecting an entry or withdrawal condition of the actuator based on an electrical signal resulting from opening and closing of the contacts. As a result of such a configuration, entry and withdrawal of the actuator can be detected from the exterior based on an electrical signal resulting from opening and closing of the contacts of the contact section.

Furthermore, the contact section can include a normally-open contact provided inside the switch main unit and a normally-closed contact used for control of operation of an external device, and be configured such that the normally-open contact and the normally-closed contact adopt an open and closed condition, respectively, due to motion of the operating rod pursuant to entry of the actuator; an electrical signal for detection of entry of the actuator is obtained based on the open condition of the normally-open contact; and the condition of the external device is switched from an inoperable condition to an operable condition based on the closed condition of the normally-closed contact. With such a configuration, while the normally-closed contact becomes closed pursuant to entry of the actuator and the external device changes from an inoperable condition to an operable condition, the normally-open contact becomes open pursuant to entry of the actuator. In this way, in addition to entry and withdrawal of the actuator, it is possible to confirm a condition of the external device from the exterior by monitoring the open-close condition of the normally-open contact, performing an opposite open-close operation to the normally-closed contact.

Furthermore, the drive section can be configured so as to have a hinge-type electromagnet provided in the lock mechanism section and arranged such that a direction of a central axis of the hinge-type electromagnet is substantially perpendicular to a motion direction of the lock member, and a transmission section displaced by a force of magnetic attraction resulting from energizing of the hinge-type electromagnet and moving the lock member by transmitting the displacement to the lock member. (Claim 3) With such a configuration, the hinge-type electromagnet is arranged such that a direction of a central axis thereof is substantially perpendicular to a motion direction of the lock member, and the lock member is moved by the electromagnetic force of attraction generated by energizing the hinge-type electromagnet and relayed to the lock member via transmission section with the direction of working thereof deflected. In this way, since the electromagnetic force of attraction generated by energizing the hinge-type electromagnet is relayed to the lock member via transmission section with the direction of working thereof deflected, in comparison to usage of the electromagnetic force of attraction in a straight-line fashion such as by a plunger-type electromagnet, it is possible to provide a thinner, more compact safety switch.

Furthermore, a configuration can also be such that the switch main unit has a rectangular parallelepiped shape, an actuator entry opening is formed at one of a pair of opposing corner portions of the switch main unit, a cable extraction opening is formed at the other, and a cable is extracted from the cable extraction opening substantially in a direction of joining of the pair of opposing corner portions. (Claim 4) With such a configuration, the relationship between the actuator entry opening and the cable extraction opening realizes a high degree of freedom in terms of a cable extraction direction, and the safety switch can be provided on a wall surface or on a protective door; furthermore, the actuator entry opening can be arranged so as to be horizontal or vertical. Furthermore, either a front or rear surface of the safety switch can be attached to the mounting location. Accordingly, a degree of freedom with regard to mounting of the safety switch is increased, and a wider range of safety switch mounts are selectable.

Furthermore, a configuration can also be such that at least the lock member of the lock mechanism is provided as a unit and arranged so as to be capable of being freely built into and removed from the drive section. With such a configuration, since the lock member is provided as a unit and arranged so as to be capable of being freely built into and removed from the drive section, even in a situation wherein the lock member breaks, it is sufficient to replace this unit in order to restore the safety switch efficiently and in a short period of time.

As explained above, according to a first aspect of the present invention, even in a situation wherein an attempt is made to forcibly withdraw and extract the actuator from the operation section with the rotation of the drive cam locked in this way, not less than one of the notch cut-out section of the drive cam and the lock member is broken and the drive cam becomes capable of rotating, the operating rod becomes capable of moving as the operating rod makes sliding contact with the cam curve section of the drive cam, and the contacts of the contact section perform opening and closing normally. Therefore, for example, based on this opening and closing of contacts, extraction (withdrawal) of the actuator can be detected and withdrawal of the actuator from the switch main unit can be detected in a sure and reliable manner.

Furthermore, according to a second aspect of the present invention, as the fracture strength of the tip section of the lock member is set lower than the fracture strength of the notch cut-out section of the drive cam, the tip section of the lock member is more liable to break than the notch cut-out section of the drive cam. Accordingly, replacement of the broken lock member alone makes it possible to restore the safety switch, and the cost required for restoring the safety switch can be reduced.

Furthermore, according to a third aspect of the present invention, the hinge-type electromagnet is arranged such that a direction of a central axis thereof is substantially perpendicular to a motion direction of the lock member, and the lock member is moved by the electromagnetic force of attraction generated by energizing the hinge-type electromagnet and relayed to the lock member via transmission section with the direction of working thereof deflected; therefore, in comparison to usage of the electromagnetic force of attraction in a straight-line fashion such as by a plunger-type electromagnet, it is possible to provide a thinner, more compact safety switch.

Furthermore, according to a fourth aspect of the present invention, the relationship between the actuator entry opening and the cable extraction opening makes it possible for the safety switch to be provided on a wall surface or on a protective door, and in addition, the actuator entry opening can be arranged so as to be horizontal or vertical. Furthermore, either a front or rear surface of the safety switch can be attached to the mounting location. Accordingly, a degree of freedom with regard to mounting of the safety switch is increased, and a wider range of safety switch mounts are selectable.

DETAILED DESCRIPTION OF THE INVENTION

First Embodiment

The following is a description of a first embodiment of the present invention with reference to drawings FIGS. 1 to 5. FIGS. 1 to 4 illustrate cross-sectional views of a switch main unit, and FIGS. 5A and 5B illustrate an exterior view of a safety switch.

Figure 1:
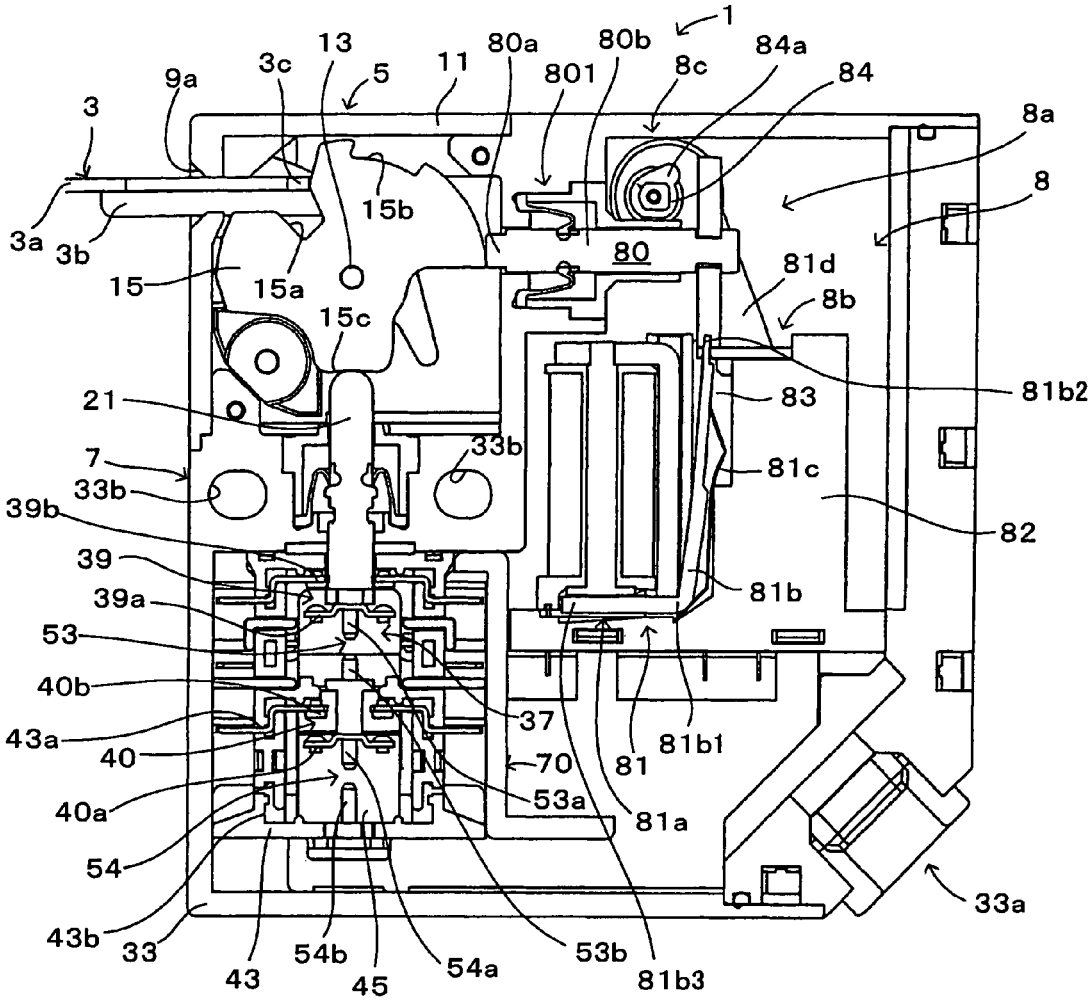
FIG. 1 is a cross-sectional view of a switch main unit according to a first embodiment of the present invention.

A safety switch according to the present invention is, in almost the same way as the above-explained conventional item, a switch connected electrically via a cable to an external device in the form of industrial machinery such as a robot etc., and as shown in FIG. 1, includes a switch main unit 1 and an actuator 3.

At this time, the switch main unit 1 includes an operation section 5, a switch section 7, and a lock mechanism section 8, and is fixed to a peripheral wall surface of a protective door of industrial machinery, omitted from the drawings. Furthermore, the actuator 3 is fixed to the protective door, the position thereof is a position opposing an actuator entry opening 9*a* formed in a side surface of the operation section 5, and when the protective door is in a closed condition, the actuator 3 enters the actuator entry opening 9*a* of the operation section 5. It should be noted that the actuator 3 includes, as shown in FIG. 1, a base 3*a*, a pair of pressing pieces 3*b* protruding from the base 3*a*, and a connecting piece 3*c* mutually connecting these pressing pieces 3*b*. At this time, in contrast to a planar pressing piece of an actuator having a large width and small thickness, both pressing pieces 3*b* have a small width and large thickness, and a cross-section wherethrough the connecting piece 3*c* passes forms a sideway U-shape.

The operation section 5 disposed at a top-left portion of the switch main unit 1 includes, as shown in FIGS. 1 to 4, a case member 11 and a drive cam 15 having a rotating shaft 13 pivotably supported on an inner surface of this case member 11 and supported so as to be capable of freely rotating. At an upper portion of an outer peripheral surface of this drive cam 15, an engaging section 15*a* wherein the connecting piece 3*c* of the actuator 3 is fit by insertion is formed at a position that can be seen via the above-explained actuator entry opening 9*a*. In addition, a notch cut-out section 15*b* engaging with a lock member 80 of a lock mechanism section 8 explained hereinafter is formed at an upper portion of the outer peripheral surface of this drive cam 15. Furthermore, a cam curve section 15*c* is formed at a bottom portion of the outer peripheral surface of the drive cam 15, and a semispherical tip of an operating rod 21 having a tip portion protruding so as to be capable of freely entering and withdrawing with respect to the operation section 5 from the switch section 7 disposed below the operation section 5 is in sliding contact with the cam curve section 15*c* of the drive cam 15. Also, when the operating rod 21 reciprocates entry and withdrawal movement pursuant to rotation of the drive cam 15, an open-close condition of a contact of a contact section 70 integrated into the switch section 7 is switched.

Next, the switch section 7 is explained. This switch section 7 includes, as shown in FIG. 1, the contact section 70, constituting an interior of a case member 33 integrated with the case member 11 and forming a switch main unit 1 of a rectangular parallelepiped shape and disposed below the operation section 5, wherein a contact is integrated, and the above-explained operating rod 21. Furthermore, it is configured such that a side of the case member 11 towards the operation section 5 can be mounted on this case member 33 so as to be freely attachable and detachable. In addition, a cable extraction opening 33*a* of a cable for external connection is formed in a corner portion at a side towards the case member 33 opposing a corner portion at a side towards the case member 11 wherein the actuator entry opening 9*a* is formed. Furthermore, as shown in FIG. 1, a pair of mounting holes 33*b* wherein bolts for mounting the switch main unit 1 onto a peripheral wall surface of a protective door of industrial machinery are inserted is formed in outer surface of the case member 33.

It should be noted that a movable member 37 capable of moving integrally with the operating rod 21 and contacting another end portion of the operating rod 21 and first and second normally-closed contacts 39, 40 opening and closing in a coupled manner with this movable member 37 are provided in the contact section 70. Each of the normally-closed contacts 39, 40 includes a movable terminal 39*a*, 40*a* and a fixed terminal 39*b*, 40*b*; each of the movable terminals 39*a*, 40*a* is fixed to the movable member 37; and each of the fixed terminals 39*b*, 40*b* is fixed to a frame member 43 provided in the contact section 70. Here, one of the normally-closed contacts 39, 40, for example, the normally-closed contact 39, is for providing and cutting off a supply of power to the industrial machinery and is connected in series with a normally-closed contact provided in the lock mechanism section 8 explained hereinafter. Furthermore, the normally-closed contact 40 is for monitoring an open-close condition of these contacts for providing and cutting off a supply of power.

Also, the movable member 37 includes a planar base section 45 and a first mounting section 53 and a second mounting section 54 arranged vertically at both ends of one face of this base section 45 (the surface side of FIG. 1); one end side thereof is in contact with the other end of the operating rod 21 and a coil spring (not shown) is mounted on the other end side thereof; and the movable member 37 is urged in a direction of the operation section 5, that is, in an upward direction, by the coil spring. Furthermore, a pair of protrusions 53*a* and 53*b*, and a pair of protrusions 54*a* and 54*b* are provided on the mounting sections 53, 54 respectively so as to be mutually opposed in a longitudinal direction of the movable member 37.

Figure 2:
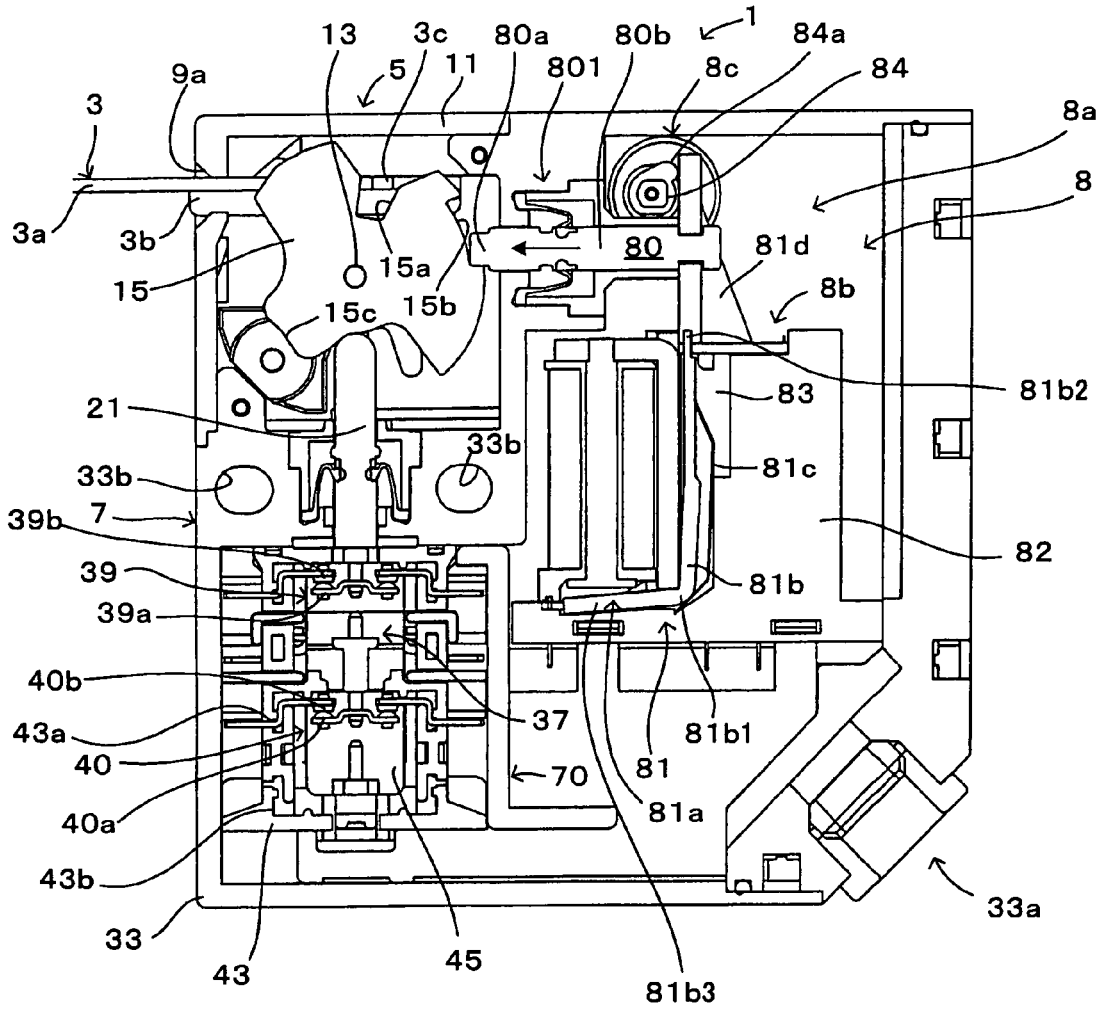
FIG. 2 is a cross-sectional view of the switch main unit according to the first embodiment of the present invention.

Also, the movable terminals 39*a*, 40*a* of the first and second normally-closed contacts 39, 40 are each mounted so as to be freely attachable and detachable on a foot portion of one of each pair of the protrusions, namely, the protrusions 53*a*, 54*a*; the movable terminals 39*a*, 40*a* are fixed in a pressed manner on the mounting sections 53, 54 respectively, by a spring (not shown) externally fitted on each of the protrusions 53*a*, 53*b*, 54*a*, 54*b*; and through an action of these springs, as shown in FIG. 2 in particular, a contact force is produced between the movable terminals 39*a*, 40*a* and the fixed terminals 39*b*, 40*b*, respectively.

Here, a cable (not shown) connected electrically to the industrial machinery is attached to the case member 33; the cable and each of the normally-closed contacts 39, 40 are connected electrically within the contact section 70; and detection of entry and withdrawal of the actuator 3 with respect to the operation section 5 and provision and cutting off of a supply of power to the industrial machinery can be carried out using an electrical signal resulting from opening and closing of each of the normally-closed contacts 39, 40.

It should be noted that the fixed terminal 40*b* of the second normally-closed contact 40 is, as shown in FIG. 1, mounted so as to be freely attachable and detachable on a normally-closed contact mounting section 43*a* formed on the frame member 43 of the contact section 70, is mounted such that the mounting position and mounting condition thereof can change together with the movable terminal 40*a*, and can switch the second normally-closed contact 40 to a normally-open contact.

That is to say, in addition to the above-explained normally-closed contact mounting section 43*a*, a normally-open contact mounting section 43*b* on which the fixed terminal 40*b* can mounted so as to be freely attachable and detachable is formed on the frame member 43, and the second normally-closed contact 40 can be switched to a normally-open contact by removing the moveable terminal 40*a* of the second normally-closed contact 40 from one of the protrusions 54*a* and mounting on the side of the other protrusion 54*b*, and removing the fixed terminal 40*b* from the normally-closed contact mounting section 43*a* and mounting on the normally-open contact mounting section 43*b*. In this way, as this normally-open contact performs an opposite open-close operation to that of the first normally-closed contact 39, it can be used as a contact for monitoring of a different operation to that in the case of the second normally-closed contact 40, and normally-open or normally-closed can be selected in accordance with intended use.

It should be noted that, in a condition of FIG. 1 wherein the actuator 3 has not entered, the operating rod 21 is pushed by the cam curve section 15*c* of the drive cam 15 against the coil spring and is in a condition wherein the most part thereof is sunken towards the side of the switch section 7, and the movable member 37 is being pressed upon by the operating rod 21. As a result of this, the movable terminals 39*a*, 40*a* and the fixed terminals 39*b*, 40*b* of each of the u normally-closed contacts 39, 40 separate, each of the normally-closed contacts 39, 40 is in an open condition, the supply of power to the industrial machinery is cutoff, and the industrial machinery is in an inoperable condition.

Next, the lock mechanism section 8 is explained. This lock mechanism section 8, as shown in FIG. 1, is provided inside the case member 33 and disposed rightward of the operation section 5 and includes a lock mechanism 8*a* having the above-explained lock member 80 and a drive section 81 moving the lock member 80, a lock contact section 8*b* wherein normally-open and normally-closed contacts are integrated, and a manual lock release mechanism 8*c*.

The lock member 80 constituting a part of the lock mechanism 8*a* is supported by a lock member support section 801 so as to be capable of freely moving between an unlock position shown in FIG. 1 and a lock position shown in FIG. 2 in a direction substantially perpendicular to that of the rotating shaft 13 of the drive cam 15. Furthermore, an outer diameter of a tip section 80*a* of the lock member 80 is structured so as to be smaller than an outer diameter of a base 80*b*. Also, when the lock member 80 moves to the lock position, a rotation of the drive cam 15 is locked as a result of the tip section 80*a* engaging with the notch cut-out section 15*b* of the drive cam 15. Meanwhile, when the lock member 80 moves to the unlock position, the engagement between the tip section 80*a* and the notch cut-out section 15*b* is released and the drive cam 15 becomes capable of rotation.

Furthermore, the drive section 81 includes a hinge-type electromagnet 81*a* formed by wrapping a coil on a core; a working member 81*b* formed in an approximate L-shape from magnetic material such as iron, etc. which displaces when acted upon by an electromagnetic force of attraction resulting from energizing of the hinge-type electromagnet 81*a*; a return spring 81*c* formed from a leaf spring and urging the working member 81*b* leftward; and a link member 81*d* transmitting displacement of the working member 81*b* to the lock member 80. The hinge-type electromagnet 81*a* is arranged such that a direction of a central axis thereof is substantially perpendicular to a motion direction of the lock member 80, and is supported by a case 82 of the lock contact section 8*b*. Furthermore, as shown in FIG. 1, the hinge-type electromagnet 81*a* is supported by the case 82 so as to produce a gap 83 between the hinge-type electromagnet 81*a* and the case 82, and the working member 81*b* and the return spring 81*c* are provided in the gap 83.

The working member 81*b* is a member of an approximate L-shape formed such that a bend section 81*b*1 thereof has an obtuse angle and is provided within the gap 83 so as to be capable of freely oscillating with the bend section 81*b*1 portion as a central axis of swinging. Furthermore, the return spring 81*c* is disposed rightward of the working member 81*b* within the gap 83 such that the urging force thereof works in a leftward direction. Furthermore, the link member 81*d* is connected to an upper end section 81*b*2 of the working member 81*b*, and the lock member 80 is pivotally supported by the link member 81*d*.

Accordingly, as shown in FIG. 2, if energizing of the hinge-type electromagnet 81*a* is shutoff, the working member 81*b* is urged leftward by the return spring 81*c* and the upper end section 81*b*2 moves leftward with the bend section 81*b*1 portion as a central axis of swinging. Also, pursuant to the leftward motion of the upper end section 81*b*2, the link member 81*d* connected to the upper end section 81*b*2 moves leftward, and the lock member 80 pivotally supported by the link member 81*d* moves in an arrow direction of FIG. 2, or in other words, towards the lock position. Meanwhile, if the hinge-type electromagnet 81*a* is energized, a bottom-left end section 81*b*3 of the working member 81*b* is drawn to the hinge-type electromagnet 81*a* by the electromagnetic force of attraction of the hinge-type electromagnet 81*a*. As a result, the upper end section 81*b*2 of the working member 81*b* moves rightward against the urging force of the return spring 81*c* and with the bend section 81*b*1 as a central axis of swinging. Also, pursuant to the rightward motion of the upper end section 81*b*2, the link member 81*d* connected to the upper end section 81*b*2 moves rightward, and the lock member 80 pivotally supported by the link member 81*d* moves in an arrow direction of FIG. 3, or in other words, towards the unlock position. In this way, in this embodiment, the working member 81*b* and the link member 81*d* function as a "transmission section" of the present invention.

Furthermore, normally-open and normally-closed contacts (not shown) are provided inside the case 82 of the lock contact section 8*b*. Of these normally-open and normally-closed contacts, each movable contact is supported by the above-explained link member 81*d*. Accordingly, these moving members each move in the same direction in a coupled manner with a motion of the link member 81*d*. In this embodiment, when the link member 81*d* moves leftward, or in other words, when the lock member 80 moves to the lock position, the normally-open and normally-closed contacts each adopt an open and closed condition, respectively; and when the link member 81*d* moves rightward, or in other words, when the lock member 80 moves to the unlock position, the normally-open and normally-closed contacts each adopt a closed and open condition, respectively. And as explained above, for example, a normally-closed contact within the case 82 is connected in series with the normally-closed contact 39 of the contacts provided in the contact section 70 and connected to the industrial machinery. Furthermore, an operation of the lock member 80 can be detected by monitoring an electrical signal of these normally-open contacts.

In addition, the manual lock release mechanism 8*c* is provided with a release cam 84 having a projection 84*a*. As shown in FIG. 2, when the lock member 80 moves to the lock position and the lock member 80 becomes engaged with the notch cut-out section 15*b*, the lock condition can be released by turning the release cam 84 clockwise from the exterior of the switch main unit 1 using, for example, a release key. That is to say, by turning the release cam 84 clockwise, the link member 81*d* can be moved rightward as the projection 84*a* makes sliding contact with the link member 81*d*. As a result, pursuant to the rightward motion of the link member 81*d*, the lock member 80 pivotally supported by the link member 81*d* also moves rightward in a coupled manner, the condition of engagement between the lock member 80 and the notch cut-out section 15*b* is released, and the drive cam 15 can be made capable of rotating.

Next, an operation is explained. As shown in FIG. 1, when the actuator 3 has not entered the operation section 5 of the switch main unit 1, the operating rod 21 is pushed by a large diameter portion of the cam curve section 15*c* of the drive cam 15 against the coil spring and is in a condition wherein the most part thereof is sunken towards the side of the switch section 7, and the movable member 37 is being pressed upon by the operating rod 21. As a result of this, the movable terminals 39*a*, 40*a* and the fixed terminals 39*b*, 40*b* of each of the normally-closed contacts 39, 40 separate, each of the normally-closed contacts 39, 40 is in an open condition, the supply of power to the industrial machinery is cutoff, and the industrial machinery is in an inoperable condition. Furthermore, the lock member 80 is pushed against the return spring 81*c* by an outer periphery portion of the drive cam 15 and moves to the unlock position, and the normally-open and normally-closed contacts of the lock contact section 8*b* are closed and open, respectively.

Next, when the actuator 3 enters the operation section 5 as a result of closure of a protective door, etc., as shown in FIG. 2, the connecting piece 3*c* of the actuator 3 engages with the engaging section 15*a* of the drive cam 15, and pursuant to entry of the actuator 3, the drive cam 15 is rotated clockwise. Pursuant to the rotation of drive cam 15, the operating rod 21 moves upward as a result of the urging force of the coil spring while a tip of the operating rod 21 makes sliding contact from a large diameter portion to a small diameter portion of the cam curve section 15*c*. Pursuant to the upward motion of the operating rod 21, the normally-closed contacts 39, 40 change from an open condition to a closed condition. Furthermore, the notch cut-out section 15*b* moves to a position opposing the lock member 80 pursuant to the rotation of the drive cam 15, and consequently, the lock member 80 moves leftward as a result of the urging force of the return spring 81*c*, the notch cut-out section 15*b* and the tip section 80*a* of the lock member 80 become engaged, rotation of the drive cam 15 is locked, and extraction of the actuator 3 is prevented. In addition, as a result of the lock member 80 moving to the lock position, the normally-open and normally-closed contacts of the lock contact section 8*b* switch to an open and closed condition, respectively. Accordingly, the normally-closed contact of the lock contact section 8*b* and the first normally-closed contact 39 are simultaneously in a closed condition, and therefore, a supply of power is provided to robots and other industrial machinery connected in series with these normally-closed contacts, and the industrial machinery can operate.

Figure 3:
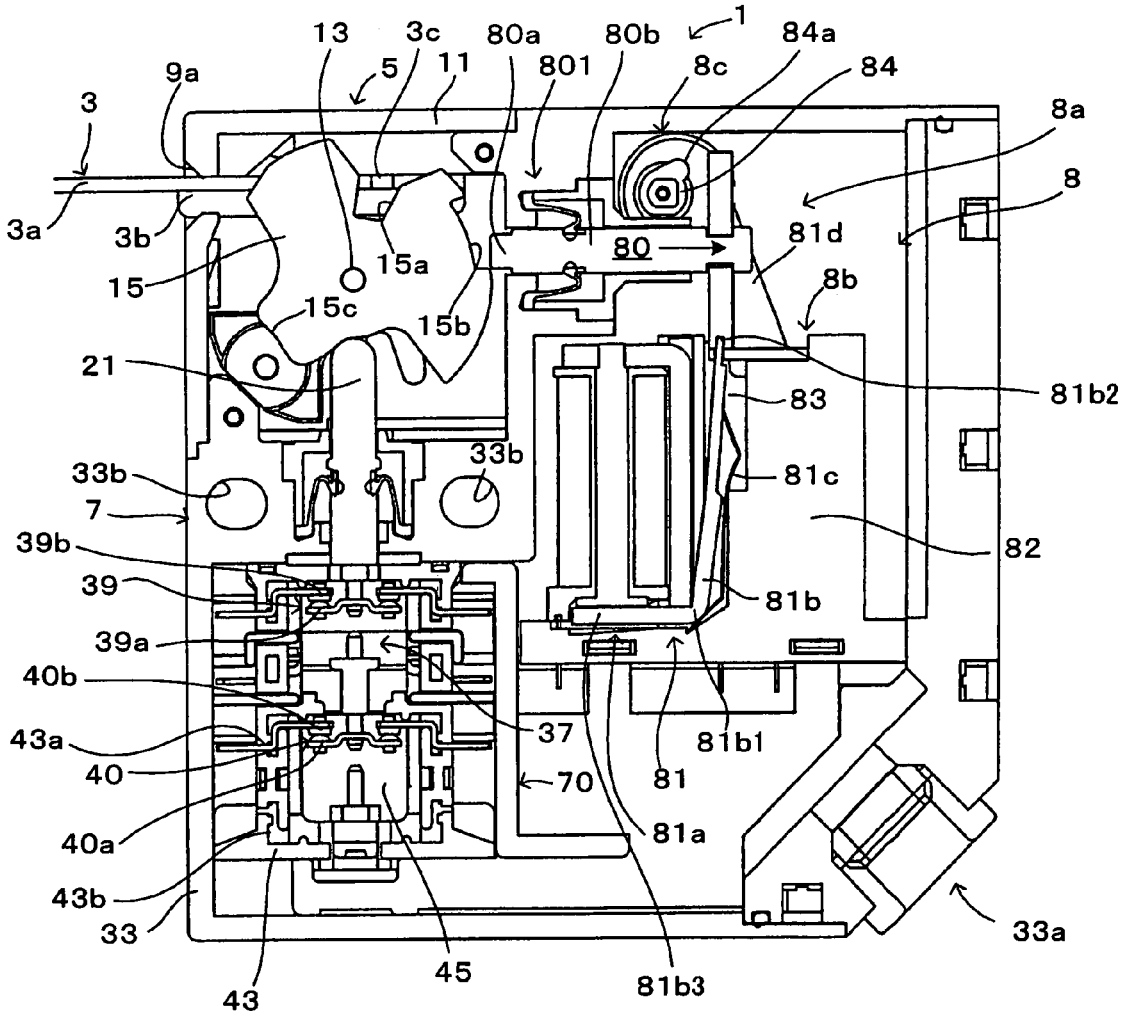
FIG. 3 is a cross-sectional view of the switch main unit according to the first embodiment of the present invention.

Next, when the hinge-type electromagnet 81*a* is energized as a result of external control, as shown in FIG. 3, the bottom-left end section 81*b*3 of the working member 81*b* is drawn towards the hinge-type electromagnet 81*a* by the electromagnetic force of attraction of the hinge-type electromagnet 81*a*. Consequently, the upper end section 81*b*2 of the working member 81*b* moves rightward against the urging force of the return spring 81*c* with the bend section 81*b*1 as a central axis of swinging, and as a result, the lock member 80 moves to the rightward unlock position. Accordingly, the condition of engagement between the lock member 80 and the notch cut-out section 15*b* is released, and therefore, the lock condition of the rotation of the drive cam 15 is released, the actuator 3 becomes capable of withdrawal, and the protective door, etc. can be opened. Furthermore, pursuant to motion of the lock member 80 to the unlock position, the normally-closed and normally-open contacts of the lock contact section 8*b* switch to an open and closed condition, respectively, and as a result, the supply of power to the industrial machinery connected in series with the normally-closed contact of the lock contact section 8*b* and the first normally-open contact 39 is cutoff, the industrial machinery becomes incapable of operation, and in addition, the unlock condition is detected using an electrical signal flowing through the normally-open contact of the lock contact section 8*b*.

Figure 4:
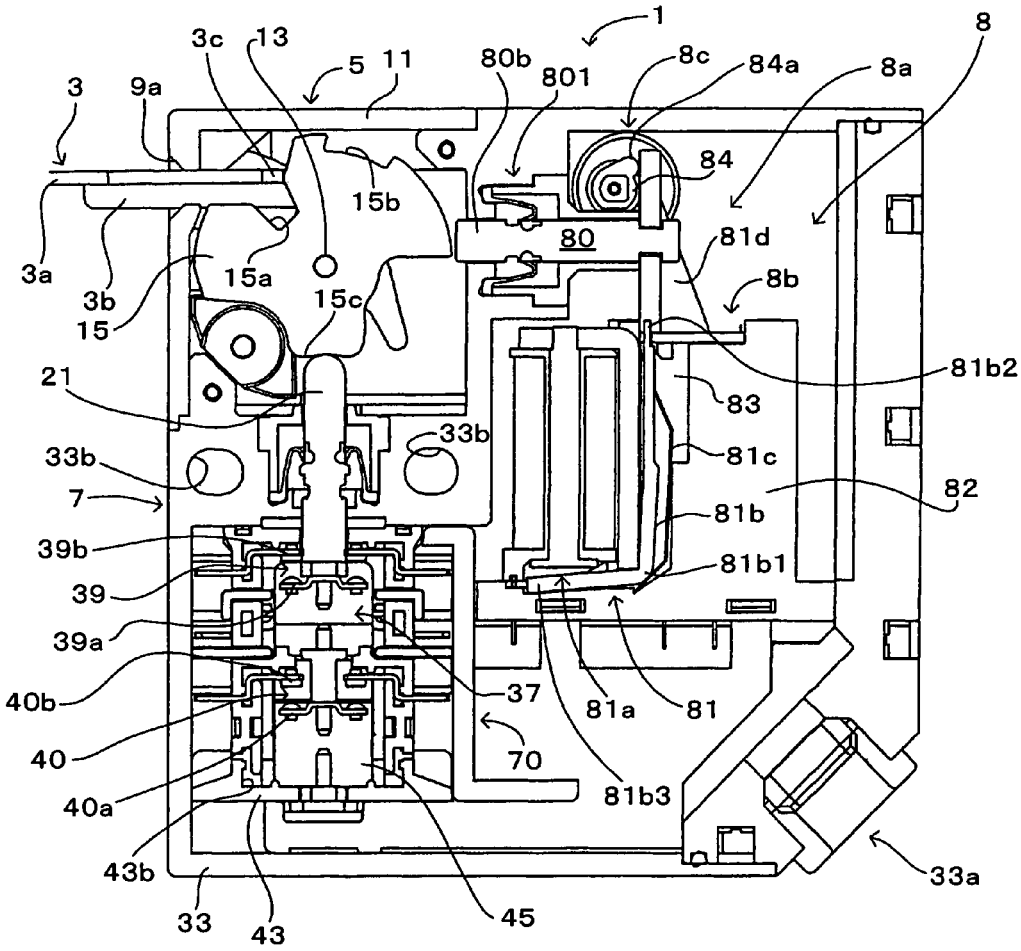
FIG. 4 is a cross-sectional view of the switch main unit according to the first embodiment of the present invention.

The following is a detailed description of a situation wherein an attempt is made to forcibly withdraw and extract the actuator 3 from the operation section 5 with, as shown in FIG. 2, the rotation of the drive cam 15 in a locked condition, with reference to FIGS. 2 and 4. As the connecting piece 3*c* of the actuator 3 is engaged with the engaging section 15*a* of the drive cam 15, when the actuator 3 is forcibly withdrawn, a forcible rotation force is applied to the drive cam 15. At this time, the tip section 80*a* of the lock member 80 remains engaged with the notch cut-out section 15*b* of the drive cam 15, and therefore, a force of extraction of the actuator 3 is concentrated in a portion of engagement of the tip section 80*a*, engaged with the drive cam 15, and the notch cut-out section 15*b*. Also, if the actuator 3 is forcibly extracted from the switch main unit 1, as the diameter of the tip section 80*a* is small and the fracture strength of the tip section 80*a* has been set lower than the fracture strength of the notch cut-out section 15*b*, the tip section 80*a* of the lock member 80 of lower fracture strength breaks before the notch cut-out section 15*b* of the drive cam 15, and the drive cam 15 becomes capable of rotation.

Then, pursuant to withdrawal of the actuator 3 from the operation section 5, the drive cam 15 is rotated in a counter-clockwise direction and the connecting piece 3*c* of the actuator 3 comes free of the engagement condition with the engaging section 15*a*. At this time, as shown in FIG. 4, as the cam curve section 15*c* of the drive cam 15 and the operating rod 21 are in a normal condition and free of breakage, pursuant to the counter-clockwise rotation of the drive cam 15, the operating rod 21 moves downward against the urging force of the coil spring while the operating rod 21 makes sliding contact from a small diameter portion to a large diameter portion of the cam curve section 15*c*. Also, pursuant to the downward motion of the operating rod 21, the normally-closed contacts 39, 40 of the contact section 70 adopt an open condition normally. That is to say, the normally-closed contacts 39, 40 provided in the contact section 70 are operating normally, and therefore, based on the condition of these normally-closed contacts 39, 40, extraction (withdrawal) of the actuator 3 is detected and the supply of power to the industrial machinery is surely and reliably cutoff.

As explained above, in this embodiment, by forcibly withdrawing and extracting the actuator 3 from the operation section 5 with rotation of the drive cam 15 locked, the lock member 80, having lower fracture strength, breaks, and even when the drive cam 15 becomes capable of rotation, the cam curve section 15*c* of the drive cam 15 and the operating rod 21 are in a normal condition and free of breakage. Therefore, when the drive cam 15 is rotated in a counter-clockwise direction pursuant to withdrawal of the actuator 3 from the operation section 5 and the connecting piece 3*c* of the actuator 3 comes free of the engagement condition with the engaging section 15*a*, the operating rod 21 moves downward while the operating rod 21 makes sliding contact from a small diameter portion to a large diameter portion of the cam curve section 15*c*. Also, since the normally-closed contacts 39, 40 of the contact section 70 switch normally to an open condition pursuant to this downward motion of the operating rod 21, extraction (withdrawal) of the actuator 3 can be detected based on this condition of the normally-closed contacts. Accordingly, even in a situation wherein a protective door, etc. is forcibly opened without the lock being released normally and the actuator 3 is extracted from the switch main unit 1, withdrawal of the actuator 3 from the switch main unit 1 can be detected in a sure and reliable manner.

Furthermore, in this embodiment, as the fracture strength of the tip section 80*a* of the lock member 80 is set lower than the fracture strength of the notch cut-out section 15*b* of the drive cam 15, the tip section 80*a* of the lock member 80 is more liable to break than the notch cut-out section 15*b* of the drive cam 15. For this reason, even if the tip section 80*a* of the lock member 80 breaks, replacement of the broken lock member 80 alone makes it possible for the safety switch to again be used in a normal condition, and therefore, a cost reduction can be realized.

Furthermore, in this embodiment, as detection of a condition of entry and withdrawal of the actuator 3 with respect to the operation section 5 is carried out using an electrical signal resulting from opening and closing of the normally-closed contacts 39, 40 provided in the contact section 70, entry and withdrawal of the actuator 3 can be detected from the exterior using the electrical signal resulting from opening and closing of the normally-closed contacts 39, 40.

Furthermore, in this embodiment, the hinge-type electromagnet 81*a* is arranged such that a direction of a core (central axis) thereof is substantially perpendicular to a motion direction of the lock member 80 between the lock position and the unlock position, and the lock member 80 is moved by the electromagnetic force of attraction generated by energizing the hinge-type electromagnet 81*a* and relayed to the lock member 80 via the working member 81*b* and the link member 81*d* with the direction of working thereof deflected, and therefore, in comparison, for example, to usage of the electromagnetic force of attraction in a straight-line fashion such as by a plunger-type electromagnet, it is possible to realize a thinner, more compact entire safety switch.

Figure 5A:
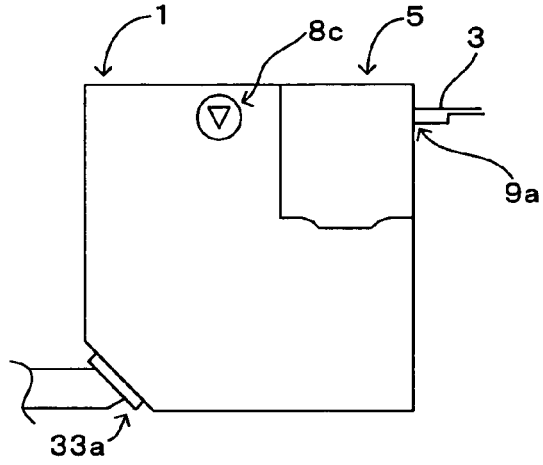
FIGS. 5A and 5B are an exterior view of a safety switch according to the first embodiment of the present invention.
Figure 5B:
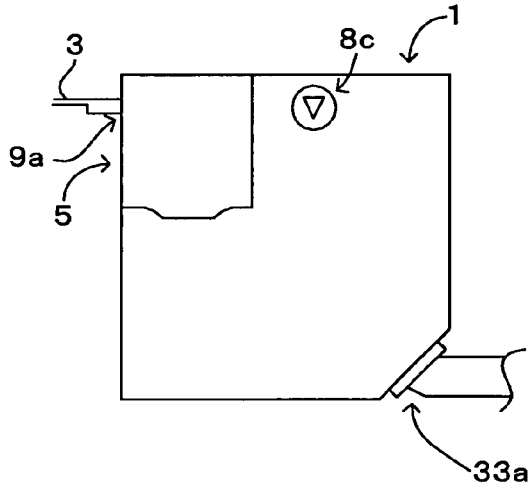

Furthermore, in this embodiment, the switch main unit 1 has a rectangular parallelepiped shape, and the actuator entry opening 9*a* is formed at one of a pair of opposing corner portions of the switch main unit 1 and the cable extraction opening 33*a* is formed at the other. For this reason, as shown in FIGS. 5A and 5B, the relationship between the actuator entry opening 9*a* and the cable extraction opening 33*a* realizes a high degree of freedom in terms of a cable extraction direction, and the safety switch can be provided on a wall surface or on a protective door; furthermore, the actuator entry opening can be arranged so as to be horizontal or vertical. Furthermore, either a front or rear surface of the safety switch can be attached to the mounting location. Accordingly, a degree of freedom with regard to mounting of the safety switch is increased, and a wider range of safety switch mounts are selectable. Furthermore, as such a configuration increases the degree of freedom with regard to safety switch mounting, it is acceptable to not provide two actuator entry openings as in the conventional technology, and therefore, it is possible to prevent breakage of the safety switch as a result of the entry of dust, etc. from the actuator entry opening on the unused side, and to also improve the durability of the safety switch. It should be noted that FIG. 5A is a view with a front surface of a safety switch on a top side, and FIG. 5B is a view with a back surface of a safety switch on a top side.

Second Embodiment

Figure 6:
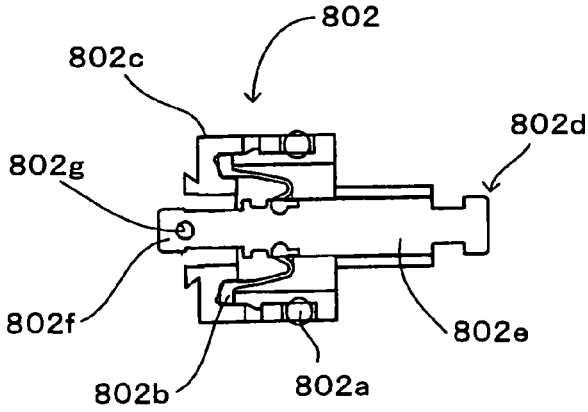
FIG. 6 is a view illustrating a lock member unit according to a second embodiment of the present invention.

FIG. 6 is a view illustrating a lock member unit according to the present invention, and the following is a detailed description of a second embodiment of a safety switch according to the present invention, with reference to FIG. 6. The major point of difference between this second embodiment and the above-explained first embodiment is the provision of a lock member of a lock mechanism as a unit and arranged so as to be capable of being freely built into and removed from a drive section, and all other configurations and operations are identical to those of the first embodiment. The following is a detailed description of the second embodiment, focusing on differences with the first embodiment. It should be noted that, in terms of configurations and operations that are identical to those of the first embodiment, an explanation is omitted.

As shown in FIG. 6, a lock member unit 802 is configured such that a lock member 802*d* is supported by a lock support section 802*c* and seal members 802*a*, 802*b*. Also, this lock member unit 802 is provided upward of the hinge-type electromagnet 81*a* of the drive section so as to be capable of being freely built into and removed. Furthermore, the lock member 802*d* includes a base 802*e* and a tip section 802*f* connected to the base 802*e*, and a hole 802*g* is formed at the boundary between the base 802*e* and the tip section 802*f* in order to reduce a fracture strength.

In this way, since the lock member 802*d* is provided as a unit in the form of the lock member unit 802 and arranged so as to be capable of being freely built into and removed from the drive section, even in a situation wherein the lock member 802*d* breaks, it is sufficient to replace this lock member unit 802 in order to restore the safety switch efficiently and in a short period of time. Furthermore, as the hole 802*g* is provided in order to reduce the fracture strength of the tip section 802*f* of the lock member 802*d*, if the actuator is forcibly extracted from the safety switch main unit, the tip section 802*f* of the lock member 802*d* is surely and reliably broken first and the notch cut-out section of the drive cam can be maintained in a normal condition. Accordingly, when the safety switch is broken as a result of forcible extraction of the actuator from the entire safety switch main unit, the safety switch can be restored to a normal condition simply by replacing the lock member unit 802.

Other

Figure 7A:
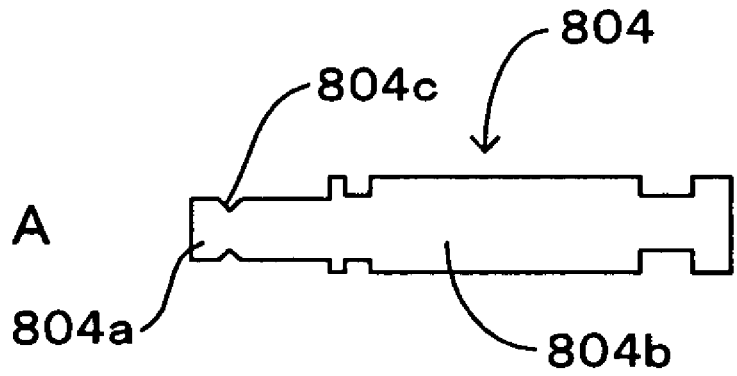
FIGS. 7A and 7B are a view illustrating a lock member according to another embodiment of the present invention.
Figure 7B:
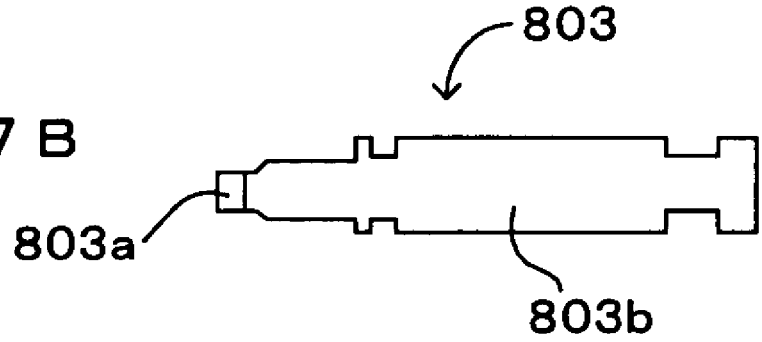

Furthermore, the lock member is not limited to the above-explained configuration, and for example, the various changes illustrated in FIGS. 7A and 7B can be added. It should be noted that FIGS. 7A and 7B illustrate a lock member. A lock member 804 shown in FIG. 7A includes a base 804*b* and a tip section 804*a* connected to the base 804*b*, and for example, a deficiency section 804*c* of a groove shape is formed in order to reduce a fracture strength at a boundary portion between the tip section 804*a* and the base 804*b*. Furthermore, the lock member 803 shown in FIG. 7B includes a base 803*b* and a tip section 803*a* connected to the base 803*b*, and the tip section 803*a* is formed by attachment to the base 803*b*. At this time, the base 803*b* and the tip section 803*a* can either be the same member or be different members. As a result of such a configuration, when the actuator is forcibly extracted from the safety switch main unit, the tip of section of the lock member, and not the notch cut-out section of the drive cam, can be broken in a sure and reliable manner. It should be noted that, in a condition wherein the above-explained deficiency section is provided, it is naturally acceptable for the configuration to bond the base and the tip section.

It should be noted that the present invention is not restricted to the above-explained embodiments, and as long as there is no departure from the gist thereof, a variety of changes may be added to the above-explained items. For example, one of the normally-closed contacts provided in the contact section can be a normally-open contact. In such a case, the normally-closed contact can be used for control of operation of an external device, and the normally-open contact can be a contact for obtaining an electrical signal for detection of entry of the actuator. With such a configuration, while the normally-closed contact becomes closed pursuant to entry of the actuator and the external device changes from an inoperable condition to an operable condition, the normally-open contact becomes open pursuant to entry of the actuator. In this way, in addition to entry and withdrawal of the actuator, it is possible to confirm a condition of the external device from the exterior by monitoring the open-close condition of the normally-open contact, performing an opposite open-close operation to the normally-closed contact.

Furthermore, in the above-explained embodiments, since the provision and cutting off of a supply of power to the industrial machinery is carried out using two normally-closed contacts 39, 40 and based on an open-close operation thereof, in a situation wherein the movable terminals 39*a*, 40*a* and the fixed terminals 39*b*, 40*b* of the normally-closed contacts 39, 40 have fused when, for example, the normally-closed contacts 39, 40 become closed and a supply of power is provided to the industrial machinery, the fused movable terminals 39*a*, 40*a* and fixed terminals 39*b*, 40*b* can be forcibly separated as a result of withdrawal of the actuator 3 and the movable member 37 being pressed upon by the operating rod 21, improving the reliability of the safety switch.

Furthermore, although two normally-closed contacts are provided in the above-explained embodiments, there is no restriction to this, and 1, 3, or 4 or more can be provided. It should be noted that at least two normally-closed contacts are desirable in order to improve safety-switch reliability. Furthermore, as the second normally-closed contact 40 is configured so as to be capable of switching to a normally-open contact by changing the position of the movable terminal 40*a* and the fixed terminal 40*b*, the contact configuration of the switch section 7 can be easily changed in accordance with intended use.

At this time, it is sufficient only to change the positions of the movable terminal 40*a* and the fixed terminal 40*b* when the second normally-closed contact 40 is being switched to a normally-open contact, and there is no need for special components in each contact structure; therefore, cost can be reduced, and in addition, it is possible to avoid incorrect assembly of components, etc. pursuant to any increase in the number of components. It should be noted that, although the above-explained embodiments are configured such that the second normally-closed contact 40 alone is a contact capable of having the contact structure thereof switched, there is no restriction to this, and the number of contacts capable of having the contact structure thereof switched is arbitrary.

Furthermore, in the above-explained first embodiment and second embodiment, although the lock member 80 is moved to the lock position by a spring load (urging force) of the return spring 81*c* and the lock member 80 is moved to the unlock position by an electromagnetic force of attraction when the hinge-type electromagnet 81*a* is in an energized condition, it is acceptable for the lock member 80 to be moved to the lock position so as to cause the lock mechanism 8*a* to be locked using this electromagnetic force of attraction. In this case, for example, it is desirable that a return spring be arranged such that an urging force is directed so as to move the lock member 80 to the unlock position.

It should be noted that the present invention is not restricted to the above-explained embodiments, and as long as there is no departure from the gist thereof, a variety of changes may be added to the above-explained items; furthermore, it may be widely applied in assuring the safety of workers by preventing machinery from being driven when a protective door is not completely closed.

The invention claimed is:

1. A safety switch comprising:

a switch main unit having an operation section, a switch section and a lock mechanism section, the switch section including an operating rod and a contact section including a contact, an actuator provided so as to be capable of freely entering into and withdrawing from said operation section of said switch main unit, and wherein entry and withdrawal of said actuator effects opening and closing, respectively, of said contact of said contact section via a reciprocating motion in accordance with entry and withdrawal of said actuator of said operating rod provided in said switch section a drive cam that is provided so as to be capable of freely rotating in said operation section, and a lock mechanism that is provided in said lock mechanism section of said switch main unit and locks a rotation of said drive cam; wherein said drive cam having an engagement section, a notch cut-out section, and a cam curve section each formed on an outer peripheral surface of said drive cam, said engagement section engaging with a portion of said actuator pursuant to pushing in of said actuator, is rotated in one direction along with entry of said actuator into said operation section while retaining the engagement condition, and is rotated in another direction along with withdrawal of said actuator from said operation section pursuant to extraction of said actuator until the portion of said actuator comes free of the engagement condition with said engagement section, and thus said operating rod moves in a reciprocating fashion as a result of said operating rod making sliding contact with said cam curve section due to rotation of said drive cam in both directions; and said lock mechanism comprises a lock member and a drive section that moves said lock member, said look member being provided so as to be capable of freely moving between a lock position and an unlock position in a direction substantially perpendicular to a rotating shaft of said drive cam, engaging with said notch cut-out section to lock a rotation of said drive cam as a result of motion to said lock position when said actuator is in an entry condition, and being released from engagement with said notch cut-out section as a result of motion to said unlock position.

2. The safety switch of claim 1, wherein a tip section of said lock member engages with said notch cut-out section, and a fracture strength of said tip section is set lower than a fracture strength of said notch cut-out section of said drive cam.

3. The safety switch of claim 1 or claim 2, wherein said drive section comprises:

a hinge-type electromagnet provided in said lock mechanism section and arranged such that a direction of a central axis of said hinge-type electromagnet is substantially perpendicular to a motion direction of said lock member, and a transmission section displaced by a force of magnetic attraction resulting from energizing of said hinge-type electromagnet and moving said look member by transmitting the displacement to said lock member.

4. The safety switch of claim 1 or 2, wherein said switch main unit has a rectangular parallelepiped shape with an actuator entry opening formed at one of a pair of opposing corner portions of said switch main unit and a cable extraction opening formed at the other, and a cable, said cable being extracted from said cable extraction opening substantially in a direction of joining of said pair of opposing corner portions.

5. The safety switch of claim 1 or 2, wherein said switch main unit has a rectangular parallelepiped shape with an actuator entry opening formed at one of a pair of opposing corner portions of said switch main unit and a cable extraction opening at a second corner of said pair of opposing corner portions, the cable extraction opening being configured for extracting a cable from said cable extraction opening substantially in a direction of joining of said pair of opposing corner portions.

6. The safety switch of claim 3, wherein said switch main unit has a rectangular parallelepiped shape with an actuator entry opening formed at one of a pair of opposing corner portions of said switch main unit and a cable extraction opening formed at the other, and a cable, said cable being extracted from said cable extraction opening substantially in a direction of joining of said pair of opposing corner portions.

7. The safety switch of claim 3, wherein said switch main unit has a rectangular parallelepiped shape with an actuator entry opening formed at one of a pair of opposing corner portions of said switch main unit and a cable extraction opening at a second corner of said pair of opposing corner portions, the cable extraction opening being configured for extracting a cable from said cable extraction opening substantially in a direction of joining of said pair of opposing corner portions.

* * * * *